US005499907A

United States Patent [19]

Knott et al.

[11] Patent Number: 5,499,907

[45] Date of Patent: Mar. 19, 1996

[54] ROLLER PUMP FOR HEART-LUNG MACHINES

[75] Inventors: Erwin Knott, Poing; Günter Friedmann, Ubersee, both of Germany

[73] Assignee: Stöckert Instrumente GmbH, Munich, Germany

[21] Appl. No.: 387,609

[22] Filed: Feb. 13, 1995

[30] Foreign Application Priority Data

Feb. 16, 1994 [EP] European Pat. Off. ..... 94102331

[51] Int. Cl.[6] ..... F04B 17/00; F04B 43/08

[52] U.S. Cl. ..... 417/360; 417/477.9; 417/238

[58] Field of Search ..... 417/360, 477.1, 417/477.9, 238; 403/321, 322, 325

[56] References Cited

U.S. PATENT DOCUMENTS

| | | | |
|---|---|---|---|
| 4,631,008 | 12/1986 | Stenner | 417/477.1 |
| 4,842,815 | 6/1989 | Cauguelin et al. | 403/325 |
| 4,909,713 | 3/1990 | Finsterwald et al. | 417/477.1 |

FOREIGN PATENT DOCUMENTS

| | | | |
|---|---|---|---|
| 0033666 | 2/1981 | European Pat. Off. . | |
| 0147733 | 12/1984 | European Pat. Off. . | |
| 467288 | 6/1937 | United Kingdom | 417/477.1 |
| 1353156 | 10/1970 | United Kingdom . | |
| 2027283 | 7/1979 | United Kingdom . | |

*Primary Examiner*—Charles Freay

*Attorney, Agent, or Firm*—Scully, Scott, Murphy & Presser

[57] ABSTRACT

A roller pump for heart-lung machines with a pump head, consisting of a pump stator which possesses a pump bed serving as a support for a hose piece or length, and a pump rotor which is arranged in the pump stator so as to be rotatable about its central longitudinal axis and which possesses rollers rotatably supported on a roller carrier, which during a rotation of the pump rotor travel along the hose piece which is inserted into the pump head, and including a drive unit for producing the rotational movement of the pump rotor and with a pump housing for the support of the pump head and for receiving the drive unit which is inventively configured in such a manner that the drive unit is connected with the pump head whereby the pump head is moveable relative to the pump housing.

11 Claims, 3 Drawing Sheets

ROLLER PUMP FOR HEART-LUNG MACHINES

BACKGROUND OF THE INVENTION

1. Field of the Invention

The present invention relates to a roller pump, especially for heart-lung machines, wherein the roller pump possesses a pump head consisting of a pump stator and a pump rotor, a drive unit and a pump housing.

Basically, roller pumps consist of a pump head, a drive unit and a pump housing, of which, in turn, the pump head again consists of a pump stator and a pump rotor. The pump stator is an essentially cylindrical hollow chamber whose inner wall, which is designated as a pump bed, serves as a support for a hose piece or length which is inserted into the pump head and which lies against the inner wall. The pump rotor, which is rotatable about its central longitudinal axis, is arranged in the pump stator in such a manner that rollers, which are rotatably supported on a roller carrier, are rollable along the hose piece and thereby compress the hose piece. The pump stator possesses at least one opened section which is provided for the leading out of the hose, and through which the hose piece is conducted from the interior of the hollow chamber of the pump stator. In order to prevent the hose piece from wandering under the influence of the rollers of the pump rotor which are rolling therealong, at least one end of the hose piece must be fastened to the pump stator. For roller pumps with reversible running directions, it is necessary to provide for a fastening at both ends of the hose piece. The drive unit is arranged in the pump housing, which concurrently serves for the support of the pump head. Arranged within the pump housing for known roller pumps, in addition thereto, are electrical energy supply installations and control installations for the pump drive.

2. Discussion of the Prior Art

Roller pumps are utilized in the medical technology, especially in heart-lung pumps for the conveyance of blood in an artificial or simulated circulation. A portion of this circulation is the hose which is inserted into the pump head. Not only due to the occlusion of the hose, which is caused by the rollers of the roller pump, but already because of the contact with the inner wall of the hose, is the conveyance of blood by itself influenced and damaged in an undesirable manner. A goal of every utilization of blood pumps, especially for heart-lung machines, must accordingly be such that the interval of time is configured to be as short as possible during which the blood is in contact with the inner wall of the hose. Basically, this consideration leads to the concept that the inserted hose pieces must be maintained as short as possible. The known roller pumps, especially their utilization in heart-lung machines, do not support this intention. The heart-lung machine, which contains mostly a plurality of roller pumps, must in its entirety be so set up that there are obtained the shortest possible hose pieces.

However, in view of the size of a heart-lung machine, in most instances this produces undesirably lengthy hose lines, which lead to an extremely lengthy contact between the blood and the inner wall of the hose.

SUMMARY OF THE INVENTION

Accordingly, commencing from the foregoing state of the art, it is an object of the present invention to provide a roller pump of the above-mentioned type whose construction supports the intended shortening in the length of the hose.

The foregoing object is achieved through a roller pump for heart-lung machines with a pump head, consisting of a pump stator which possesses a pump bed serving as a support for a hose piece or length, and a pump rotor which is arranged in the pump stator so as to be rotatable about its central longitudinal axis and which possesses rollers rotatably supported on a roller carrier, which during a rotation of the pump rotor travel along the hose piece which is inserted into the pump head, and including a drive unit for producing the rotational movement of the pump rotor and with a pump housing for the support of the pump head and for receiving the drive unit which is inventively configured in such a manner that the drive unit is connected with the pump head whereby the pump head is moveable relative to the pump housing.

In the inventive roller pump, the pump head can be rotatable about an axis which extends in parallel with the central longitudinal axis of the pump rotor, which leads to that the outlet opening of the pump stator so the inserted hose section can be oriented in such a manner as to provide for a shortest possible overall hose length.

When one visualizes that in heart-lung machines there are frequently employed numerous auxiliary aggregates, it becomes evident that the individual orientation of the roller pumps which are inserted into the heart-lung machine, relative to the directly attached auxiliary installation, will lead to significantly shortened hose pieces. The opened section can also be oriented so as to a certain extent point toward the patient, without the necessity that the comparatively large heart-lung machine be correspondingly arranged.

When the inventive roller pump is designed so that the pump head is removable from the pump housing, then the pump head which is connected with the drive unit can be inserted into a separate housing which, as a rule, is much smaller. The significantly smaller housing, which receives the drive unit and supports the pump head, can be located in proximity to the patient or an auxiliary installation, and is connected with the heart-lung machine only through electrical energy supply and control lines. The close spatial proximity to the patient or, respectively, to the auxiliary installation of the heart-lung machine, leads to extremely short hose lengths, which are then especially necessary when an artificial or simulated blood circulation for patients with a low total quantity of blood should be built up; for example, for newborns and breast feeding infants.

When, inventively, only the pump head is removable from the pump housing, then differently sized pump heads or, respectively, dual-pump heads can be installed on one and the same base, which is advantageous not only in viewpoint of the flexibility of the roller pump or, in essence, the heart-lung machine, but also with respect to the cleaning capabilities.

In order to secure the movable pump head, there is advantageously provided a latching device by means of which the pump head is fastened to the pump housing.

In particular, for the instance in which the pump head and the drive unit are removable from the pump housing, it is necessary to impart an extremely compact configuration to the drive unit which, for this purpose, possesses an electric motor and a two-step belt drive. In order to avoid any slippage while maintaining the elasticity, there are utilized toothed belts.

As with usual roller pumps, in the inventive roller pump, there is also provided the energy source for the drive unit and/or the control unit for the control of the drive unit arranged within the pump housing. For the connection thereof it is merely necessary to provide electrical connectors which, in an extremely simple manner, can be constructed to be of suitable lengths.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
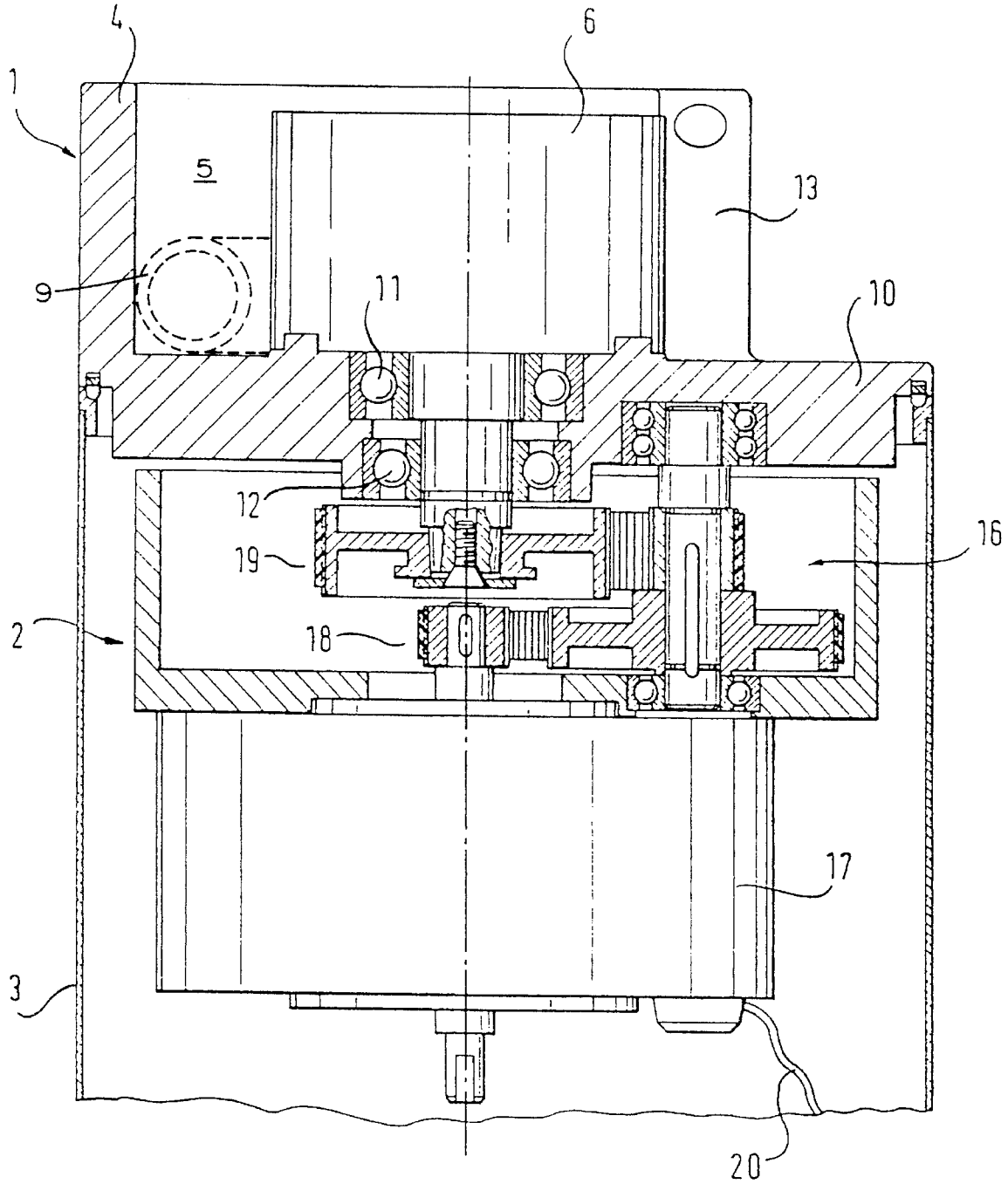
FIG. 1 illustrates an inventive roller pump shown in a sectional view.
Figure 2:
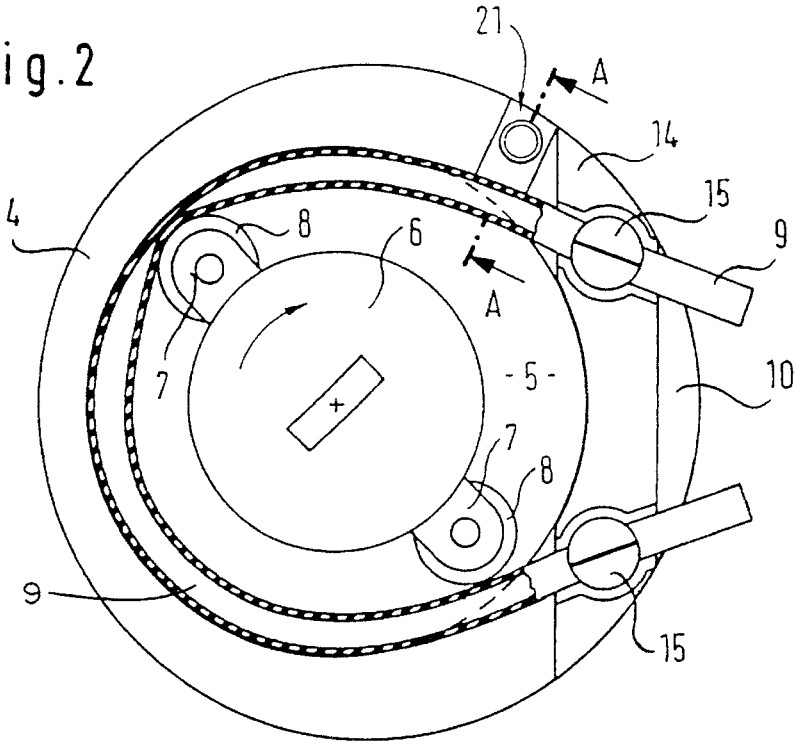
FIG. 2 illustrates the roller pump of FIG. 1 in a top plan view.

In FIG. 1 there is illustrated a roller pump which consists of a pump head 1, a drive unit 2 and a pump housing 3. The pump head 1 encompasses a pump stator 4, in the essentially cylindrical hollow chamber 5 of which there is arranged a pump rotor 6 so as to be rotatable about its central longitudinal axis. As is illustrated in FIG. 2, the pump rotor 6 possesses rollers 8 which are each presently supported on a roller carrier 7, and whereby during a rotational movement of the pump rotor 6 the rollers travel along a hose piece 9 which is inserted into the pump head. The inner wall of the cylindrical hollow chamber of the pump stator 4 serves as a counter support against which there lies the hose piece 9 as shown in FIG. 2. Third support is usually designated as a pump bed.

As is indicated in FIG. 1, the pump stator further encompasses a base plate 10 which, on the one hand, receives the bearings 11 and 12 for the support of the pump rotor and, on the other hand, serves for the support of the pump head in the housing 3. In the inventive roller pump, the pump stator 4 as well as the base plate 10 are circular in shape, so that the pump head is rotatable in the opening of the housing 3 which receives the pump head about an axis which extends in parallel with the central longitudinal axis of the pump rotor. The opened section 13 of the pump stator 4, through which the hose piece is conducted out of the cylindrical inner chamber of the pump stator can in accordance therewith be oriented in different directions, when the pump head is rotated about its axis of rotation in the opening of the housing 3. In the representation of FIG. 2, there is arranged at the opened section 13 of the pump stator 4 a hose securing module 14, which is detachable from the pump stator and resultingly from the pump head of the roller pump. Two fastening units 15 are provided in the hose securing module 14, and fixedly position the two ends of the hose piece 9 which are conducted out of the pump stator 4.

In order to be able to implement, in the described exemplary embodiment of the invention, the mentioned rotatability of the pump head, the drive unit 2 is directly fastened on the base plate 10 of the pump stator 4. The drive unit 2 is thus displaced or, in essence, rotated in conjunction with the pump head. The compact manner of construction of the drive unit 2 facilitates an arrangement thereof which is directly located on the base plate 10 of the pump stator 4. In order to achieve the compact construction, the drive unit 2 consists of a gear drive unit 16 and an electric motor 17. The gear drive unit 16 possesses two steps 18 and 19, as a result of which there is achieved the compact mode of construction for the gear drive unit 16. The two gear drive steps relate to belt drives in each of which there is respectively employed a toothed belt. The two-step belt drive which is provided in the exemplary embodiment at a compact assembly thereof attains the required reduction in the speed of rotation of the motor, and provides for the necessary elasticity which is basically sought after in the driving operation of roller pumps.

In FIG. 1 there is further illustrated the electrical connection line 20 by means of which, on the one hand, the electric motor 17 is connected with a supply voltage and, on the other hand, a control installation has signals transmitted thereto; for example such as reference position pulses. The voltage supply as well as also the control unit are, as a rule, arranged within the housing 3 (not shown). Through the inventive unity of the pump head and pump drive there is, however, opened up the possibility to separate the voltage supply and/or the control unit from the pump housing, and to be arranged in another housing part of the heart-lung machine. Advantageously, the separation restricts itself to the voltage supply for the roller pumps of a heart-lung machine. As a result thereof, there can be provided for a heart-lung machine a single voltage supply for collective roller pumps. The control units, as a rule, remain individually for each roller pump in the therewith associated pump housing, as well as the displays for the pump-specific measured parameters and operating conditions.

In FIG. 2 there is illustrated a locking or securing device 21, through the intermediary of which the pump head can be secured on the pump housing 3. A one-time or specifically selected rotational position is assured with the aid of the locking device 21. The locking device 21 can be configured for continual latching or permit a locking action only in specified rotational positions. In the following detailed, hereinbelow described locking or securing device, it relates to a locking action of the second type.

Figure 3:
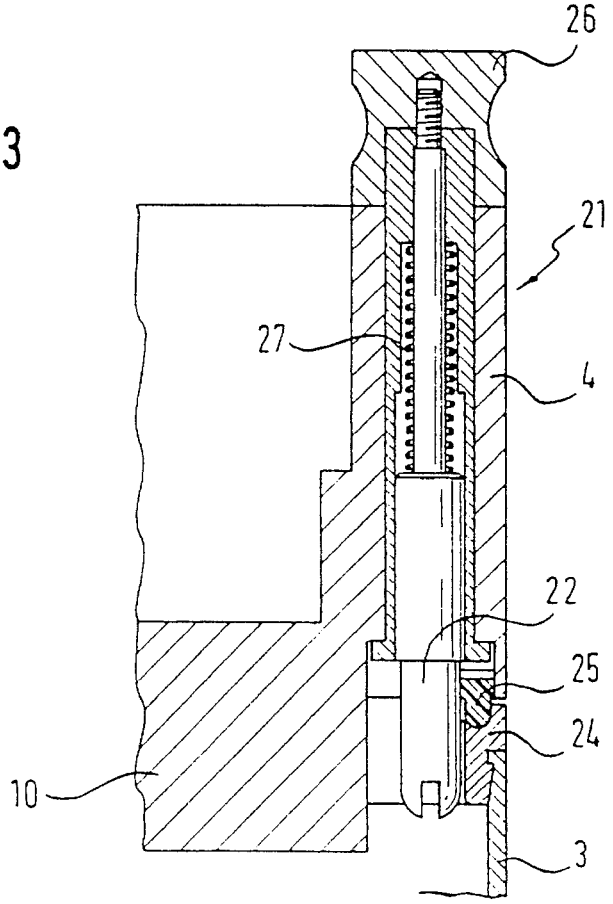
FIG. 3 illustrates a portion of the roller pump in a sectional view taken along line A—A in FIG. 2.
Figure 4:
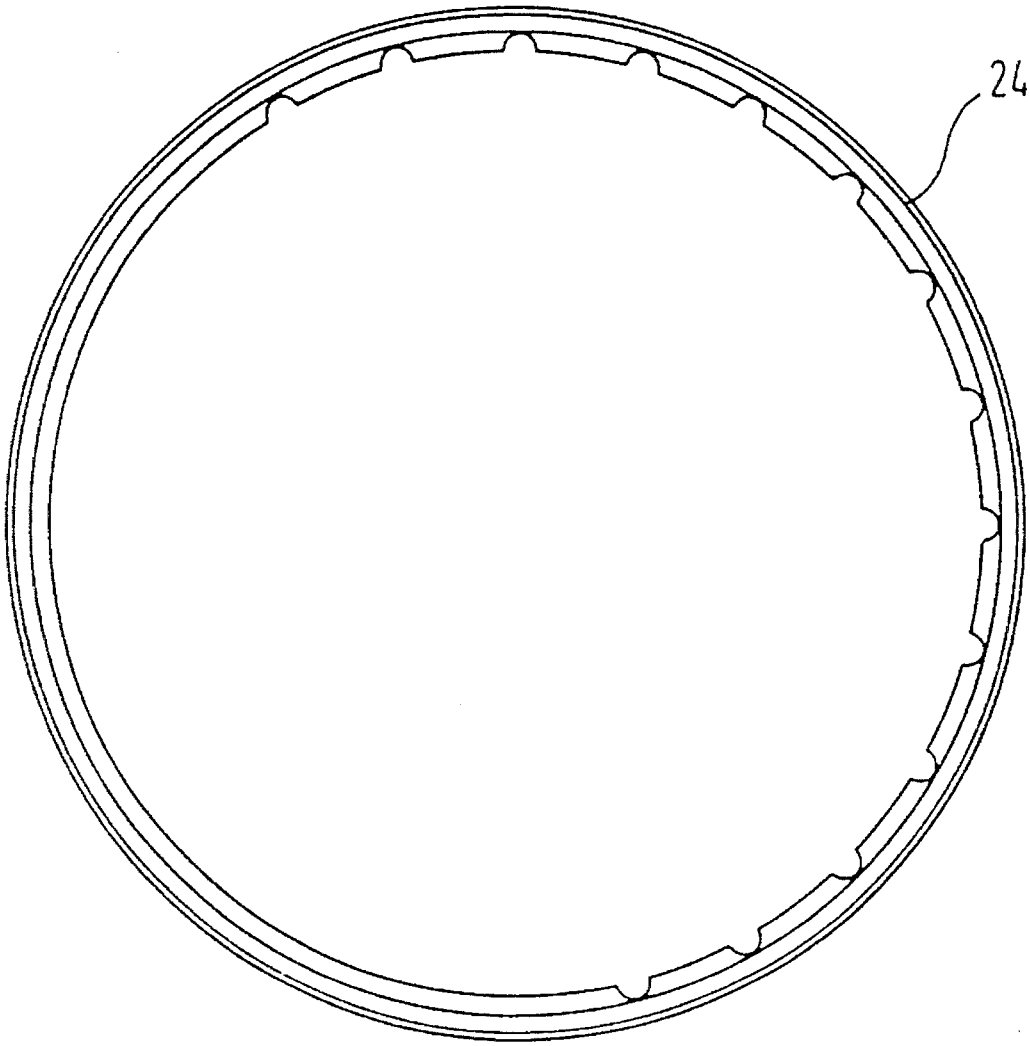
FIG. 4 illustrates a latching ring of the locking device pursuant to FIG. 3.

In this instance, reference is had to FIG. 3, which illustrates a partial sectional view of the pump stator taken along the section line A—A in FIG. 2. The locking device 21 consists of a latching or engaging pin 22 which is engageable into recesses on a latching ring 24. The latching ring is illustrated in FIG. 4 in a manner whereby there can be recognized the arrangement of the recesses, and thereby the latching positions for the pump head. The latching ring 24 is arranged in the opening of the housing 23 and remains connected with the housing. The pump head is inserted into the latching ring 24 and lies on a bearing or support member 25 which supports the rotational movement thereof, and which is arranged in a groove formed in the latching ring 24. The bearing or support member 25 pertains; for example, to a ring constituted of a plastic material, which is produced from a material which, in cooperation with the material of the pump stator, provides for the desired adhesive or, respectively, sliding coefficients of friction.

The engaging or latching pin 22 is moved in the longitudinal direction thereof from the recesses in the latching ring 24 in that, by means of a gripping member 26, there is exerted a pulling or tensile force which acts in the longitudinal direction of the latching pin 22. The pulling force acts in opposition to the restoring force of a spring 27 such that, subsequent to the release of the gripping member 26, the latching pin 22 is moved in the direction towards the latching ring, and through a rotation of the pump head is brought into latching engagement, insofar as the latching pin 22 has not yet been positioned precisely above a recess in the latching ring 24 upon the release of the gripping member 26.

Through an increase in the number of recesses provided in the latching ring 24 there can be obtained a quasi-continual distribution of the possible rotational positions of the pump head. In view of the practical applications thereof, this appears to be adequate, so that a locking device which facilitates all rotational positions is not absolutely necessary. With regard to the weight of the pump head and the drive unit, a locking action is implemented with form-fitted elements, such as is implemented by the latching pin and recess, which are to be preferred in comparison with a positive or force-transmissive locking action.

As can be ascertained from FIGS. 1 and 3, the pump head and the drive unit 2 can be commonly removed from the pump housing. When the pump housing 3 relates to a part of a pump housing which is integrated into a heart-lung machine, then there is afforded the possibility of removing the pump head and the drive unit from the heart-lung machine and to arrange them in a separate housing which, for this purpose, possesses a correspondingly correlated opening and possibly also the latching ring 24. The electrical connector line 20 can be lengthened without any difficulty, whereby in contrast therewith the hose line, through which there is conveyed the blood of the patient, can be shortened, inasmuch as the pump head and the drive unit, together with the separate housing, can be located in close proximity to the patient.

When the pump head and drive unit are left in the housing 3, then through a rotation of the pump head, an opened section 13 can be set in such a manner as to render it possible to operate with the shortest possible lengths of hose.

What is claimed is:

1. Roller pump for heart-lung machines including a pump head (1) comprising a pump stator (4) having a pump bed serving as a support for a hose piece (9), and a pump rotor (6) arranged in said pump stator for rotation about a central longitudinal axis of said pump rotor, a roller carrier (7) rotatably supporting rollers (8) on said pump rotor, said rollers traveling along the hose piece which is inserted into the pump head (1) during a rotational movement of the pump rotor (6); a drive unit (2) for producing the rotational movement of the pump rotor (6); a pump housing (3) for supporting the pump head (1) and for receiving the drive unit (2), said drive unit (2) being connected with the pump head (1) such that the pump head (1) is movable relative to the pump housing (3); and a locking device (21) for releasably securing the pump head (1) to the pump housing (3).

2. Roller pump according to claim 1, wherein the pump head (1) is rotatable about an axis extending in parallel with the central longitudinal axis of the pump rotor (6).

3. Roller pump according to claim 1 or 2, wherein said pump head (1) is removable from the pump housing (3).

4. Roller pump according to claim 1, wherein said drive unit (2) is fastened to said pump head (1) so as to be movable in conjunction with the pump head (1) relative to the pump housing (3).

5. Roller pump according to claim 4, wherein said drive unit (2) is rotatable in conjunction with the pump head (1) about an axis extending in parallel with the central longitudinal axis of the pump rotor (6).

6. Roller pump according to claim 4 or 5, wherein said drive unit (2) is removable from the pump housing (3) together with the pump head (1).

7. Roller pump according to claim 1, wherein said locking device (21) includes a latching pin (22) which is axially displaceably located on the pump stator (4), and a latching ring (24) arranged on the pump housing (3), said latching ring including recesses into which the latching pin (22) is engageable.

8. Roller pump according to claim 7, wherein a spring (27) operatively cooperates with the latching pin (22) to cause the latching pin (22) to engage into one of the recesses in the latching ring (24) responsive to a force exerted by the spring.

9. Roller pump according to claim 1, wherein said locking device (21) enables the pump head (1) to be latched in a specified rotational position on the pump housing (3).

10. Roller pump according to claim 1, wherein said drive unit (2) comprises an electric motor (17) and a two-step belt drive (16).

11. Roller pump according to claim 10, wherein the belts of the belt drive (16) comprise toothed belts.

* * * * *